US005180316A

United States Patent [19]

Miller et al.

[11] Patent Number: 5,180,316

[45] Date of Patent: Jan. 19, 1993

[54] SHIELDED ELECTRICAL CONNECTOR

[75] Inventors: Robert A. Miller, Yorba Linda; Donald F. Worden, Orange, both of Calif.

[73] Assignee: Molex Incorporated, Lisle, Ill.

[21] Appl. No.: 823,027

[22] Filed: Jan. 16, 1992

Related U.S. Application Data

[63] Continuation of Ser. No. 674,650, Mar. 25, 1991, abandoned.

[51] Int. Cl.[5] ..... H01R 9/03

[52] U.S. Cl. ..... 439/610; 439/247; 439/607

[58] Field of Search ..... 439/246, 247, 248, 249, 439/252, 607, 608, 609, 610, 95, 100, 101, 105, 108

[56] References Cited

U.S. PATENT DOCUMENTS 4,457,575 7/1984 Davis et al. .
4,557,545 12/1985 Ohtsuki et al. .
4,600,262 7/1986 Nieman et al. ..... 439/608
4,611,878 9/1986 Hall et al. ..... 439/610
4,762,508 8/1988 Tengler et al. ..... 439/607
4,838,812 6/1989 Yoshimura et al. .
4,941,836 7/1990 Bormuth ..... 439/247
4,973,268 11/1990 Smith et al. ..... 439/598 X

FOREIGN PATENT DOCUMENTS 0205868 12/1986 European Pat. Off. .

*Primary Examiner*—Larry I. Schwartz
*Assistant Examiner*—Khiem Nguyen
*Attorney, Agent, or Firm*—A. A. Tirva

[57] ABSTRACT

A shielded electrical connector includes an insulating body having at least one terminal-receiving passageway extending therethrough. A metal shield is disposed about the insulating body. Complementary interengaging detents and apertures are provided between the insulating body and the metal shield to hold the shield about the body. The metal shield is sufficiently oversized relative to the insulating body to provide a floating action therebetween notwithstanding the shield being held on the body, to facilitate inserting a terminal in the terminal-receiving passageway.

7 Claims, 3 Drawing Sheets

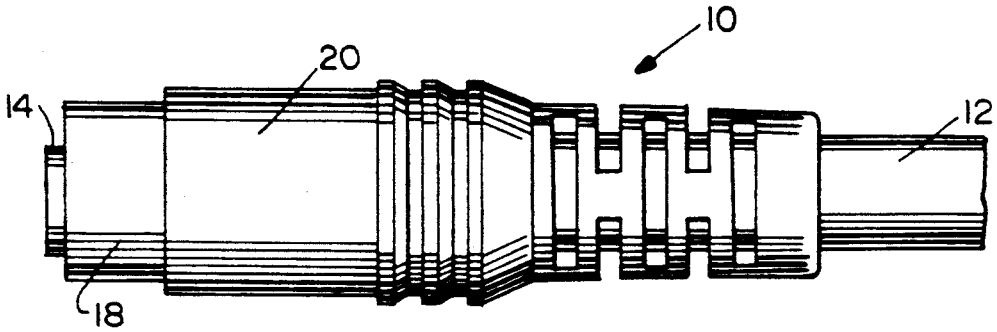
FIG. 1
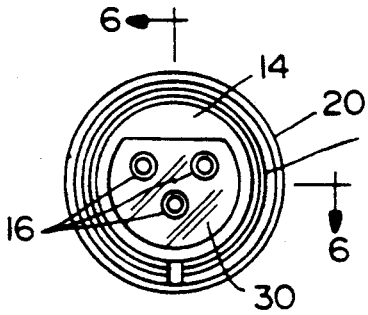
FIG. 2
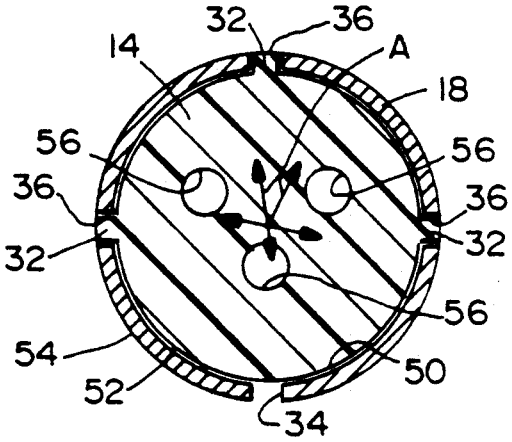
FIG. 5
FIG. 8
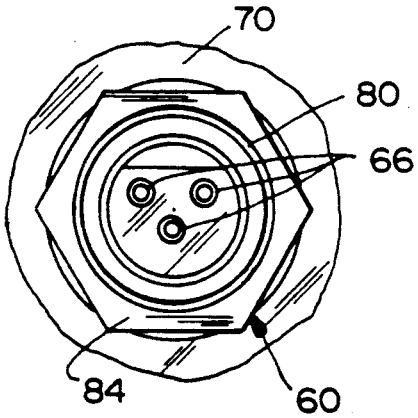
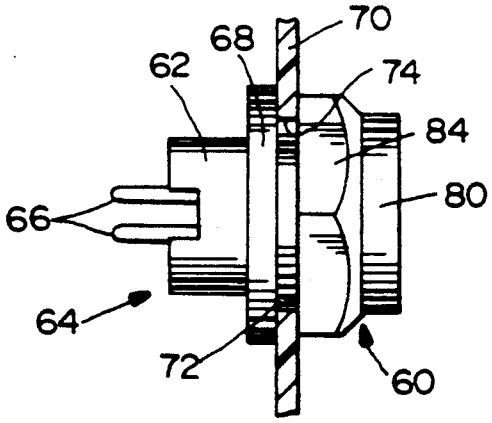
FIG. 7
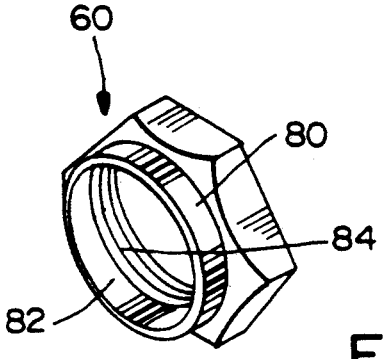
FIG. 9

SHIELDED ELECTRICAL CONNECTOR

This is a continuation of copending application Ser. No. 07/674,650 filed on Mar. 25, 1991, now abandoned.

FIELD OF THE INVENTION

This invention generally relates to the art of electrical connectors and, particularly, to a shielded electrical connector which is easy to assemble.

BACKGROUND OF THE INVENTION

Shielded electrical connectors are widely used for various applications to protect against radio frequency and electromagnetic interference and the like. Some applications include computers and their peripheral equipment, audio equipment, video equipment and similar applications. Although not confined to a particular application, the invention herein is particularly applicable for use in compact computers and particularly for use with an AC adapter for computers.

One of the problems with electrical connectors of the character described is that they are quite small in size and are rather difficult to assemble, particularly to hand assemble. Most such connectors have many parts, particularly when shielding capabilities are desired.

In particular, most such connectors are assembled by "backloading" terminals into a dielectric body or housing which is surrounded by RFI/EMI metal shield. Usually, the surrounding shield is assembled about the body with a relatively tight fit. The body has terminal-receiving passageways extending therethrough. The terminals, usually crimped to insulated wires, then are backloaded into the passageways which are quite small in dimensions. It is difficult, particularly by hand assembly, to align the terminals with the passageways, sort of like threading a needle. This is particularly true with multi-wire cables.

This invention is directed to solving these problems by providing a more readily assemblable connector of the character described.

SUMMARY OF THE INVENTION

An object, therefore, of the invention is to provide a new and improved shielded electrical connector which has improved assembly capabilities.

In the exemplary embodiment of the invention, the shielded electrical connector includes an insulating body having at least one terminal-receiving passageway extending therethrough. A metal shield is disposed about the insulating body. Complementary interengaging means are provided between the insulating body and the metal shield to hold the shield about the body. The invention contemplates that the metal shield be sufficiently oversized relative to the insulating body to provide a floating action therebetween notwithstanding the shield being held on the body. The floating action facilitates insertion of a terminal in the terminal-receiving passageway because the outside shield can be held while the terminal is inserted into the passageway of the body, and the body can move slightly to facilitate aligning the terminal with the body. The free floating disposition of the insulating body in the metal shield also facilitates alignment of the terminal with a complementary terminal of a mating connector.

Once the terminals are inserted into the body, a strain relief member is disposed about at least portions of the metal shield and the insulating body and about the terminal to hold the terminals in precise position. As disclosed herein, the strain relief member is an overmolded structure which fills areas about the shield, body and terminals.

A feature of the invention is a reduced diameter portion of the terminal-receiving passageway at a forward end of the passageway about a mating distal end of the terminal. In the case of an expandable female terminal, the reduced diameter passageway prevents overstressing of the terminal.

Other features of the invention include integral crimp means on the metal shield for crimping onto a cable having an electrical wire terminated to the terminal. The complementary interengaging means between the insulating body and the metal shield to allow the floating action therebetween, is provided in the form of a recess on one of the body and the shield, and a detent on the other of the body and the shield extending into the recess. The connector is shown herein as being of a circular configuration, particularly the insulating body being generally round in cross-section and the metal shield being generally cylindrical.

Another feature of the invention is the provision of a panel adapter for receiving the shielded connector through an opening in a panel or a mounting bracket. The adapter includes a dual-function lock nut which has a first portion in the form of an internally threaded nut for threadingly engaging an adapter body which extends through the panel aperture. An integral cylindrical portion projects axially from the internally threaded portion for telescopingly engaging the shield of the electrical connector. The multi-purpose lock nut and shield is fabricated as a one-piece member.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

FIG. 1 is a side elevational view of the shielded electrical connector of the invention;

FIG. 2 is an end elevational view, looking toward the left-hand end of FIG. 1;

FIG. 5 is a vertical section, on an enlarged scale, taken generally along line 5—5 of FIG. 4;

FIG. 7 is a side elevational view of the adapter, mounted in an aperture in a panel, the panel being in section;

FIG. 8 is an end elevational view of the adapter, looking toward the right-hand end of FIG. 7; and FIG. 9 is a perspective view of the one-piece shielding lock nut of the adapter shown in FIGS. 7 and 8.

DETAILED DESCRIPTION OF THE PREFERRED EMBODIMENT

Figure 3:
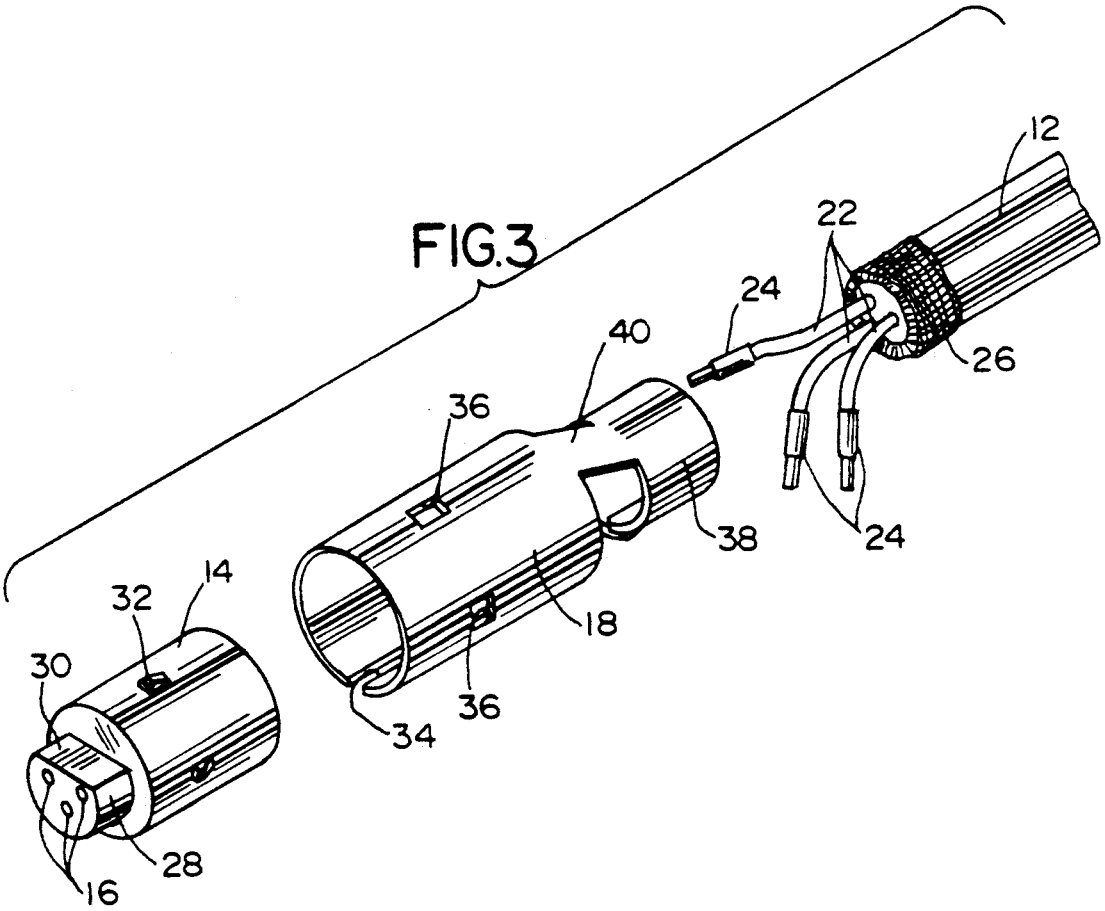
FIG. 3 is an exploded perspective view of the metal shield, insulating body and terminal components of the connector.

Referring to the drawings in greater detail, and first to FIGS. 1 and 2, the invention is embodied in a shielded electrical connector, generally designated 10, for terminating a multi-wire electrical cable 12. The components of the connector which are visible in FIGS. 1 and 2 are an inner insulating body 14 having a plurality of terminal-receiving passageways 56, the mating open ends of which are visible at 16 in FIG. 2. A metal shield 18 is disposed about insulating body 14, and a strain relief member 20 is overmolded about all of the described components, including terminals (not visible in FIGS. 1 and 2) terminated to wires from cable 12.

Referring to FIG. 3, cable 12 includes three insulation-coated electrical wires 22, the conductors of which are terminated to three female terminals or contacts 24 which are crimped to the conductors. A braided shield 26 is shown turned back over the distal end of the outer insulating coating of cable 12. This cable/terminal configuration is generally known.

Insulating body 14 has a forwardly projecting plug portion 28 with a polarizing flat 30. The terminal-receiving passageways extend through body 14 and plug portion 30, with the ends 16 again being visible in FIG. 3. Body 14 is generally round in cross-section and includes a plurality of radially outwardly projecting detents 32.

Metal shield 18 is generally cylindrical and includes a longitudinal slot 34 to provide yielding flexibility therefor. The shield has a plurality of detent-receiving apertures 36. In addition, shield 18 has a slotted, rearwardly projecting crimp portion 38 integrally joined thereto by a web portion 40. The shield is fabricated as a stamped and formed metal member.

Figure 4:
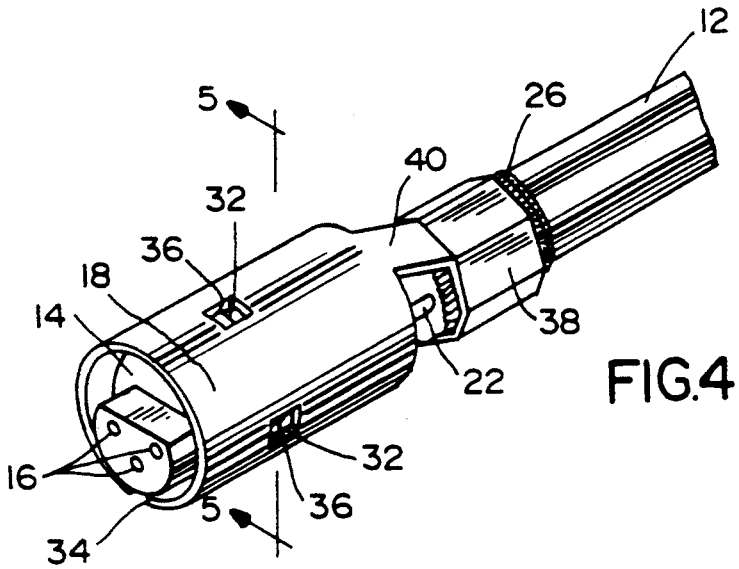
FIG. 4 is a perspective view of the insulating body assembled in the metal shield.
Figure 10:
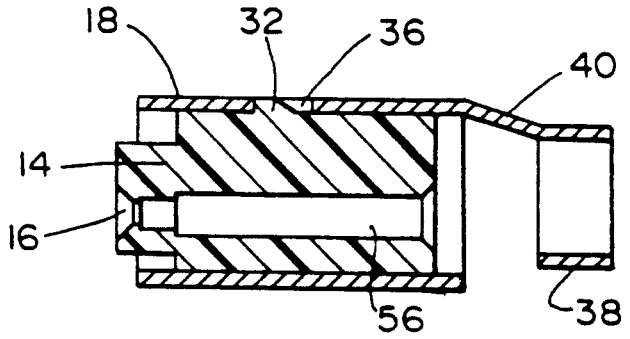
FIG. 10 is a cross-sectional view of the metal shield and insulating body assembly of FIG. 3, taken along their longitudinal axes.

FIG. 4 shows cable 12, electrical wires 22, insulating body 14 and metal shield 18 in a sub-assembled condition. More particularly, in assembly, insulating body 14 is inserted longitudinally into metal shield 18 until detents 32 of the insulating body snap into apertures 36 in the metal shield. The metal shield can expand, due to slot 34, to allow this interconnection between the body and the shield.

Cable 12, with terminals 24 crimped to the conductors of wires 22, then is inserted longitudinally through the rear end of crimped portion 38 of shield 14, and the terminals are backloaded into the rear ends of the terminal-receiving passageways through insulating body 14. After the terminals are backloaded into the insulating body, crimped portion 38 is tightly crimped onto cable 12, around braided shield 26, whereby the braid of the shielded cable now is conductively coupled to metal shield 18 through crimped portion 38 and web portion 40.

The final step of assembling connector 10 is to overmold strain relief member 20 over the sub-assembly shown in FIG. 4, the overmolded strain relief member having the configuration shown in FIG. 1. All of the spaces around crimped member 38, wires 22, shield 18 and the rear end of insulating body 14 are filled with molten plastic material of which the strain relief member is fabricated to secure all of those interior components in their assembled condition.

Referring to FIG. 5, the invention contemplates that metal shield 18 be sufficiently oversized relative to insulating body 14 to provide a floating action therebetween notwithstanding the shield being held on the body by complementary interengaging means in the form of detents 32 and apertures 36. In other words, the inside diameter 50 of cylindrically-shaped metal shield 18 is slightly larger than the outside diameter 52 of insulating body 14. This leaves a gap 54 between the shield and body 14 whereby the body freely moves or floats in all radial directions as indicated by arrows "A" in FIG. 5. To this end, detents 32 are sufficiently long in a radial direction that they constantly remain at least partially projecting into apertures 36 in shield 18 regardless of the amount of the floating movement of the body within the shield.

This floating movement of the body has proven quite effective in facilitating assembly of terminals 24 into terminal-receiving passageways 56 (FIG. 5) in the insulating body. This is particularly true with hand assembly operations. In other words, an operator can grasp metal shield 18 between his or her fingers of one hand, and backload terminals 24 into passageways 56 with the other hand. If the insulating body were rigid with the surrounding metal shield, this backloading of the terminals would be very tedious because precise manipulations are required. However, since the body floats slightly relative to the held shield, the backloading process is made easier because the terminals can be "jiggled" slightly until they "home" into the rear entrances of passageways 56. Once backloaded, overmolded strain relief member 20 holds the terminals in position, along with positioning of wires 22 and crimped cable 12 relative to shield 18 and the rear end of body 14.

Figure 6:
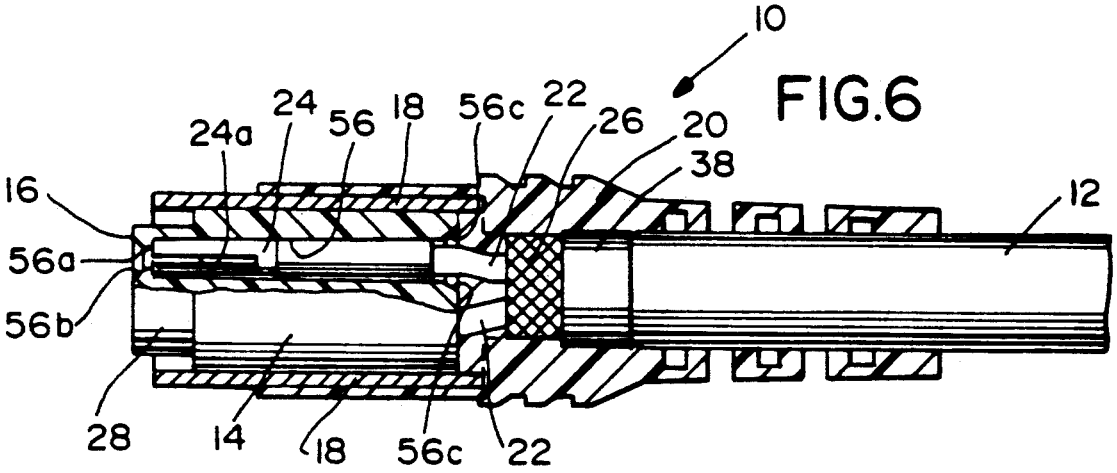
FIG. 6 is an axial section through electrical connector of the invention, as taken generally along line 6—6 of FIG. 2.

More particularly, FIG. 6 shows overmolded strain relief member 20 completely surrounding cable 12, braided shield 26, crimped portion 38 of shield 18, the interface between wires 22 and the rear end of insulating body 14, and around a substantial area of the outside of shield 18. The overmolded material is relatively soft plastic material and, when molten, is sufficiently viscous so that it does not flow into the terminal-receiving passages nor through holes 36 in the shield past detents 32 on the body nor in the spacing (FIG. 5) between the outside of body 14 and the inside of shield 18. Consequently, the free floating action between the shield and the body is not interfered with by the overmolded material. As stated above, this free floating action facilitates alignment of the terminals with complementary terminals of a mating connector. It can be seen in FIG. 6 that the overmolded material just engages the rear end of insulating body 14.

FIG. 6 shows that female terminals 24 are bifurcated by diametrically opposite slots 24*a*, whereby the terminals are expandable for receiving complementary male terminal pins of a mating connector, by an interference fit. FIG. 6 also shows that terminal-receiving passages 56 have reduced diameter portions 56*a* at the forward ends of the passages, immediately inside open ends 16. The reduced diameter portions perform dual functions. First, they provide shoulders which define the forward limits of insertion of the terminals when backloading the terminals into the insulating body. In fact, for manual assembly, they provide a tactile indication of full insertion of the terminals. Second, they prevent damage to and overstressing of the terminals should a terminal pin be inserted into the open end of one of the passages at an angle or with excessive transverse forces.

Lastly, FIG. 6 shows that the front open end of passages 56 are chamfered, as at 56*b*, to guide the complementary terminals of a mating connector into the passages; and the rear ends of the passage are chamfered, as at 56*c*, to guide terminals 24 into the passages.

Another feature of the invention is shown in FIGS. 7-9 and comprises a dual-function lock nut, generally designated 60, which is threaded onto an insulating body 62 of a panel mounted adapter, generally designated 64. More particularly, adapter 64, in addition to insulating body 62, includes a plurality of contact pins 66 extending entirely therethrough. Mating ends of pins 66 are visible in FIG. 8 for mating with female terminals 24 assembled within insulating body 14 of connector 10.

As seen in FIG. 7, insulating body 62 of adapter 64 has a peripheral flange 68 for abutting against one side of a panel or mounting bracket 70. A forwardly projecting, externally threaded portion 72 of the insulating body protrudes through an aperture 74 in the panel. Lock nut 60 is threaded onto portion 72 to rigidly secure the adapter to the panel, through aperture 74. Therefore, adapter 64, with contact pins 66, can mate with two mating connectors each having female terminals, such as a pair of shielded connectors 10.

It is desirable to provide shielding capabilities for adapter 64. Heretofore, this has been accomplished by providing a separate shielding member, such as a cylindrical member which telescopes over the metal shield of a mating connector, e.g., telescopingly receiving cylindrical metal shield 18 of connector 10. Such separate shielding members not only are expensive, but they add just another step in assembling an adapter to a panel for receiving a connector.

As seen in FIGS. 7 and 9, lock nut 60 includes a nut portion 80 having internal threads 84 for threading onto adapter portion 72, and an integral unthreaded cylindrical portion 82 sized to telescope over and grip the outside of metal shield 18 of connector 10. This one-piece member performs the dual function of locking adapter 64 to panel 70 as well as shielding the adapter by coupling to shield 18 of connector 10. Therefore, shielding braid 26 of cable 12 is conductively coupled through connector shield 18 to the adapter shield which is the integral portion 84 of lock nut 60.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector assembly for a round shielded insulated cable, said cable having an end with at least one terminated lead extending therefrom and a metal sheath folded back around the outside of said end, said connector assembly including a generally cylindrical insulating body having a first diameter and at least one terminal-receiving passageway extending therethrough, and a unitary metal shield including a generally cylindrical forward portion adapted to be slidably mounted on and to engage said insulating body and a rear portion extending therefrom adapted to mechanically and electrically engage the metal sheath of said cable, said forward portion including a rear face adjacent said rear portion of the shield and a mating face spaced from said rear face along said forward portion, the improvement in said connector comprising:

the rear portion of said shield being generally cylindrical and having a second diameter smaller than said first diameter and defining an opening through which the terminated lead is to be inserted prior to being received in the passageway; and said generally cylindrical insulating body and said shield being configured so as to permit said body to be inserted into said shield only through said mating face, said rear portion being adapted to surround and engage the sheath whereby said rear portion acts as a strain relief for said insulated cable, electrically and mechanically connects the rear portion of said shield to said sheath, and is the sole means for securing the terminated lead in said terminal receiving passageway prior to the overmolding of said electrical connector assembly.

2. The connector of claim 1 in which complementary interengaging means between the insulating body and the shield hold the shield about the body in a floating fashion for facilitating the insertion of a terminated lead through the rear portion opening into said terminal receiving passageway and for facilitating alignment and mating of a complementary mating connector.

3. The electrical connector of claim 1 wherein said complementary interengaging means comprise at least one aperture in the metal shield and a corresponding detent on the insulating body projecting into the aperture.

4. The electrical connector of claim 1, having a strain relief member for finally securing the cable and metal sheath to the metal shield.

5. The electrical connector of claim 4 wherein said strain relief member is an overmolded structure about at least portions of the metal shield and the insulating body and about the terminal and at least a distal end of the cable.

6. The electrical connector of claim 2 wherein said complementary interengaging means comprise a recess formed on the shield and a corresponding detent extending into the recess formed on the insulating body.

7. The electrical connector of claim 1 wherein said metal shield is split longitudinally thereof to provide resiliency therefor to facilitate assembly of the insulating body into the metal shield.

* * * * *